US006382911B1

(12) United States Patent
Beltowski

(10) Patent No.: US 6,382,911 B1
(45) Date of Patent: May 7, 2002

(54) VENTILATION SYSTEM FOR ELECTRIC DRIVE MINE TRUCK

(75) Inventor: Mark F. Beltowski, Erie, PA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/676,009

(22) Filed: Sep. 29, 2000

(51) Int. Cl.[7] ..... F01D 1/02
(52) U.S. Cl. ..... 415/206
(58) Field of Search ..... 415/203, 206, 415/211.2, 224.5, 226, 221, 223

(56) References Cited

U.S. PATENT DOCUMENTS 4,241,666 A 12/1980 Marcusson et al.
4,325,451 A 4/1982 Umeda
4,442,682 A * 4/1984 Sakata et al. ..... 415/203
4,448,573 A * 5/1984 Franz ..... 415/206
4,875,521 A 10/1989 Clemente
5,446,362 A 8/1995 Vanek et al.
5,782,605 A * 7/1998 Kohler ..... 415/211.2

* cited by examiner

*Primary Examiner*—F. Daniel Lopez
*Assistant Examiner*—Igor Kershteyn
(74) *Attorney, Agent, or Firm*—Carl A. Rowold; Keith J. Murphy

(57) ABSTRACT

A multiple outlet centrifugal blower has an impeller that provides both radial and axial airflows that are independent of each other such that an obstruction in one of the airflow does not substantially affect the flow of the other. The blower typically includes a housing having an inlet port, first and second outlet ducts, and an impeller rotatably positioned and supported within the housing. The first outlet duct is configured to receive airflow in a radial direction with respect to the blades of the impeller, and the second outlet duct is configured to receive airflow in an axial direction with respect to the blades of the impeller.

13 Claims, 2 Drawing Sheets

VENTILATION SYSTEM FOR ELECTRIC DRIVE MINE TRUCK

TECHNICAL FIELD

This invention relates generally to centrifugal blowers or fans and, more particularly, to a multiple outlet centrifugal blower for an electric drive motor for a mine truck.

BACKGROUND OF THE INVENTION

Centrifugal blowers, ventilators, fans, pumps, and similar devices are designed to move quantities of air by raising the pressure of the air and discharging it at a desired volumetric flow rate through a pipe or duct. An apparatus requiring cooling, ventilation, or pressurization is often positioned at the discharge port of the pipe or duct. In order for the air to move at a continuous volumetric flow rate through the discharge port to cool, ventilate, or pressurize the apparatus, the air must be supplied with sufficient energy to overcome the downstream backpressure at the outlet. This backpressure is the sum of the pressure drop in the downstream system caused by the resistance of the air to move through the duct and the total air pressure at the discharge port. Oftentimes the downstream system has at least two separate branches through which air must be delivered to a corresponding number of apparatus that require cooling, ventilation, or pressurization. These systems typically comprise centrifugal blowers having two or more separate impellers wherein each impeller supplies air at a volumetric flow rate specific to an apparatus connected to its respective discharge port.

Such systems are typically incorporated into electric drive mine trucks. Other applications include, but are not limited to, various other earth-moving devices, railroad locomotives, and marine vessels. AC drive motors are located inside the rear wheels of such trucks. Power from these drive motors is transferred through a double reduction gear set to the rear wheels and tires to drive the truck. During operation of AC motors of this type to drive large trucks, significant amounts of heat are generated. To combat the generated heat, a second AC drive motor and an auxiliary inverter are incorporated into the structure of the truck and are used to power two independent impellers situated on a single double-ended blower unit. Air moved by the first impeller is ducted to the rear of the truck where it is used to cool the AC drive motors located inside the rear wheels of the truck, while air moved by the second impeller is ducted to the deck of the truck and used to power components of a control group associated with the motor. Such a dual-impeller ventilation system offers the benefit of control of the auxiliary blower speed independent of the engine speed of the truck.

The configuration of such a system, however, is mechanically complex, and the efficiency of the system is often sacrificed as the degree of complexity becomes greater. For example, many systems of the prior art that utilize a second AC drive motor to power a double-ended blower unit also incorporate a clutch device to modulate the amount of power that must be drawn from the power plant. Such devices have fans that often require up to 30 horsepower to rotate when they are engaged, thereby reducing the efficiency of the power plant and the overall fuel economy of the vehicle.

Increasingly complex mechanical systems tend to require an increasing number of parts, for which the amount of maintenance also increases. Blowers having fans that are in constant rotation are especially prone to increased maintenance due to the number of moving parts such as belts, bearings, and the like that are incorporated therein. As the amount of maintenance increases, the overall costs to service the system increases. Because the operation of a mine truck requires a crew of highly trained operators, electricians, and mechanics, the operation is an expensive proposition to begin with. Maintaining the blower and duct work of a separate ventilation system may become cost prohibitive as the complexity and degree of unreliability of the system increases.

What is needed in the art is a ventilation system that eliminates the second AC drive motor that powers the two impellers on the double-ended blower unit.

SUMMARY OF THE INVENTION

A ventilation system utilizing a centrifugal blower having an impeller directly couplable to a drive motor is disclosed herein. The system may be installed on a variety of vehicles and heavy duty equipment to work in conjunction with the power plants thereof to cool, ventilate, or pressurize both the components of the control groups as well as AC drive motors and other equipment.

The blower is a multiple outlet blower having a single impeller that provides both radial and axial airflows that are independent of each other. An obstruction in the path of one of the airflows does not substantially affect the other airflow. The blower typically includes a housing having an inlet port, first and second outlet ducts, and an impeller rotatably positioned and supported within the housing. The first outlet duct is configured to receive airflow in a radial direction with respect to blades arranged on the impeller, while the second outlet duct is configured to receive airflow in an axial direction with respect to the same blades.

An inlet chamber is preferably fixedly connected to the housing. The inlet chamber is configured to receive air through an opening therein and channel air to the inlet port. The inlet chamber is typically formed of front and back walls connected by at least one sidewall. The back walls contain openings therein to allow air to enter the inlet port.

First and second outlet ducts are disposed proximate an outer edge of the housing. The first outlet duct includes a throat portion dimensioned so as to have a width that is substantially equal to the width of an impeller blade. The throat portion has a tapered surface to define the throat portion as being narrower at a point proximate the tips of the impeller blades and wider at a point proximate the outer edge of the housing. The second outlet duct is configured to extend laterally away from a plane of the impeller, and is preferably positioned diametrically opposite the first outlet duct. Both outlet ducts have access covers removably positioned thereover to allow for the maintenance of the blower without requiring disassembly of the housing.

DETAILED DESCRIPTION OF THE INVENTION

An enhanced ventilation system utilizes a blower having a centrifugal impeller rotatably coupled directly to the power plant of a vehicle to provide air to cool, ventilate, or pressurize at least two of the system components. In a preferred embodiment, the ventilation system is installed in an electric mine truck utilizing a diesel-powered drive engine. The blower provides pressurized air to power the control group components located on the deck of the truck and ventilates and cools AC drive motors located inside the rear wheels that drive the truck.

Figure 1:
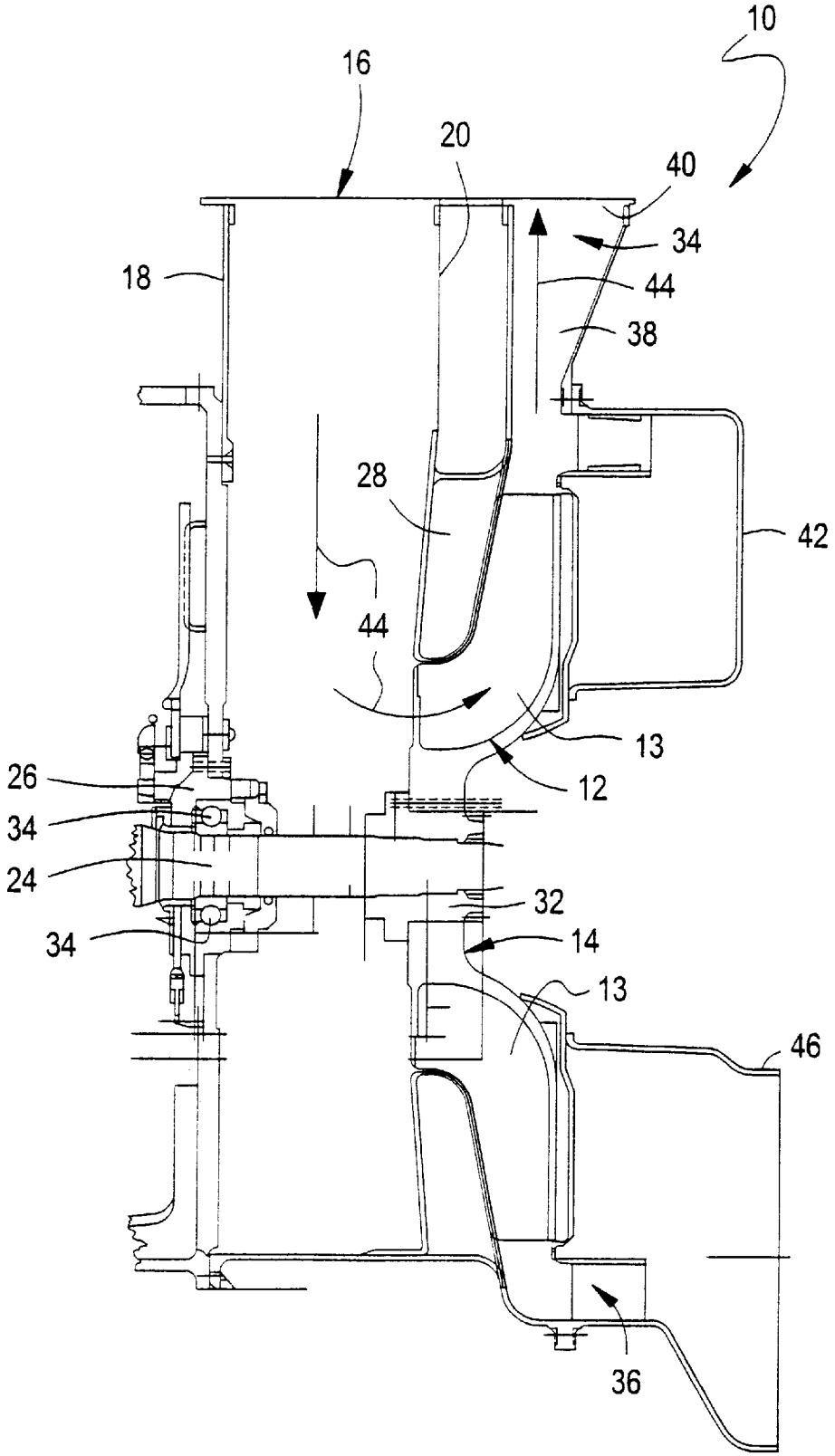
FIG. 1 is a side elevation sectional view of a preferred embodiment of a centrifugal blower.
Figure 2:
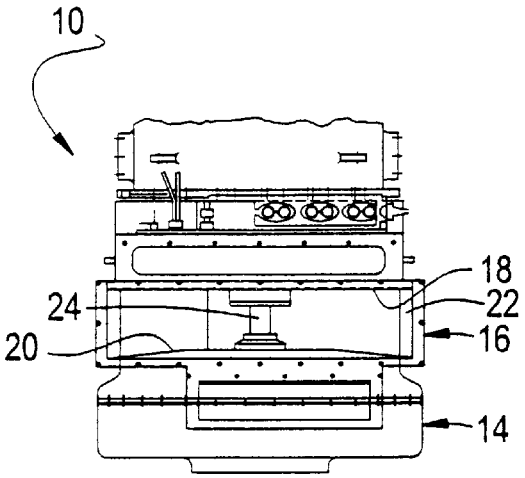
FIG. 2 is a plan view of the centrifugal blower.
Figure 3:
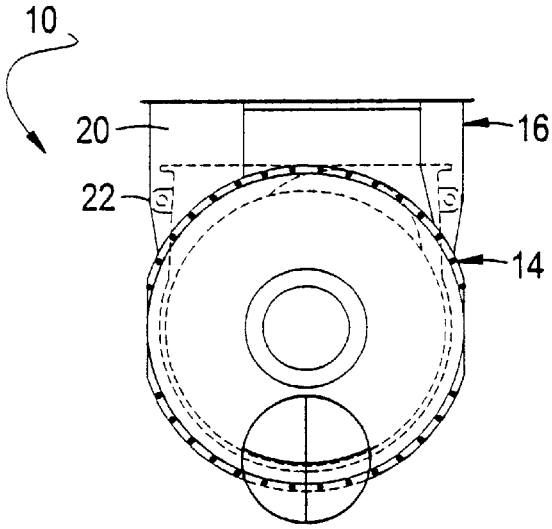
FIG. 3 is a front elevation view of the centrifugal blower.

Referring to FIGS. 1, 2, and 3, a single stage multiple outlet blower is shown generally at 10, and is hereinafter referred to as "blower 10". Blower 10 comprises an impeller, shown generally at 12 and having a plurality of blades 13 attached thereto, and a housing, shown generally at 14. Although blower 10 may incorporate a plurality of outlet ducts, in a preferred embodiment blower 10 has two outlet ducts (described below as first outlet duct and second outlet duct) that supply airflows to two separate apparatus for cooling, ventilation, or pressurization. An obstruction in the airflow to one of the two separate apparatus has little or no effect on the airflow to the other of the two separate apparatus and does not impede the normal operation of the apparatus to which the unobstructed airflow is directed.

An inlet chamber, shown generally at 16, is positioned and connected adjacent to housing 14. Inlet chamber 16 serves as the means through which the air is supplied to impeller 12 and comprises a front wall 18 and a back wall 20 positioned in a substantially parallel planar relationship and connected by at least one sidewall 22. The top portion of inlet chamber 16 is open to allow air to enter, while the bottom portion is closed. In a preferred embodiment, the bottom portion is curved to define a continuous wall that forms each sidewall 22, thereby saving space and material in the construction of inlet chamber 16. Back wall 20 is configured to extend toward front wall 18 proximate the center portion of back wall 20. A hole in the center portion of back wall 20 is dimensioned to receive a rotating shaft 24, and apertures are located proximate the hole in the center portion of back wall 20 to accommodate outlet ducts. Front wall 18 has an opening formed in the center portion thereof to accommodate a framehead 26. Inlet chamber 16 may be either fabricated from sheet metal (e.g., steel or aluminum) or molded from a suitable material (e.g., fiberglass).

Housing 14 comprises a structure similar to inlet chamber 16 and is connected to an outer surface of back wall 20 of inlet chamber 16. Housing 14 is configured and dimensioned to closely accommodate the width of each impeller blade 13 and to allow impeller 12 to freely rotate such that the clearance between each blade 13 and the inner walls of housing 14 is minimal. A hole extending through the center portion of housing 14 corresponds with the hole in inlet chamber 16 to receive rotating shaft 24 therethrough.

Impeller 12 comprises a hub 32 and blades 13 extending from a center portion of hub 32. Blades 13 are tapered and flat and may be either of the paddle-type or of the curvilinear-type in which each blade 13 is curved along a longitudinal plane of its body. Hub 32 is suitably mounted on rotating shaft 24 that extends through housing 14 and inlet chamber 16 where it is rotatably supported by bearings 34 in framehead 26. Rotating shaft 24 is an extension of a rotor shaft, which, in a preferred embodiment, is an electric current alternator driven by a diesel engine (not shown) at a speed in the range of 1,800 to about 2,100 revolutions per minute. As shown in FIGS. 1 and 2, rotating shaft 24 extends through the center of housing 14 and inlet chamber 16 and traverses inlet chamber 16. Hub 32 is mounted on the distal end of rotating shaft 24 and protrudes through framehead 26 positioned in front wall 18 of inlet chamber 16.

The side of housing 14 opposite the side to which inlet chamber 16 is connected comprises a first outlet duct and a second outlet duct, shown generally at 34 and 36, respectively. First outlet duct 34 is joined to housing 14 proximate an edge thereof and serves as a means through which air expelled by blower 10 is ducted to system components, e.g., control group elements that pneumatically regulate the supply of pressurized air to operate valves, temperature controllers, fluid-level controllers, safely devices, and other components (not shown). In a preferred embodiment, first outlet duct 34 is positioned at the topmost portion of housing 14 when blower 10 is oriented such that impeller 12 is substantially vertical relative to a level plane of a ground surface (not shown). A throat portion 38 of first outlet duct 34 is dimensioned to have a width that is substantially equal to the width of an impeller blade 13. Throat portion 38 becomes increasingly wider near an outer edge 40 of first outlet duct 34 to enable first outlet duct 34 to be connected to ductwork (not shown) that provides a pathway for air ejected therefrom to be channeled to the system components that require pressurized air. As can be best seen in FIG. 2, the cross sectional area of first outlet duct 34 is dimensioned to be less than the cross sectional area of inlet chamber 16 to enable the air ejected from first outlet duct 34 to be of a sufficient pressure to adequately power the control group components. A first access cover 42 is removably fastened to housing 14 in order to allow access to throat portion 38 and to impeller 12 for maintenance purposes without disassembling housing 14.

In FIG. 1, arrowed lines 44 illustrate the flow of air through blower 10 in a generally radial direction from the top portion of inlet chamber 16 and in outward radial directions through spaces (not shown) between each impeller blade 13 to the periphery of each impeller blade 13. In this process, the air is accelerated to a high velocity having both radial and axial components, and air pressure increases substantially as a result of the high centrifugal force. As the air passes through first outlet duct 34, the linear velocity of the air is gradually reduced, whereby some of the high velocity pressure head of the air is converted into a desired static pressure head. The pressure and volumetric flow rate of the air expelled from the first outlet duct 34 is dependent upon the physical configuration of the ductwork through which the air is channeled to the control group components, as well as the fluid backpressure in that ductwork.

Second outlet duct 36 is joined to housing 14 proximate an edge thereof and is positioned substantially diametrically opposite first outlet duct 34 and serves as a means through which air expelled by blower 10 is ducted away. In a preferred embodiment, the air is ducted to the rear of a truck to ventilate and cool the AC drive motors (not shown) that drive the truck. Second outlet duct 36 extends laterally away from housing 14 to connect to ductwork (not shown), which may or may not be flexible hosing. A second access cover 46 is removably fastened to housing 14 over second outlet duct 36 in order to allow access to impeller 12 without disassembling housing 14.

Figure 4:
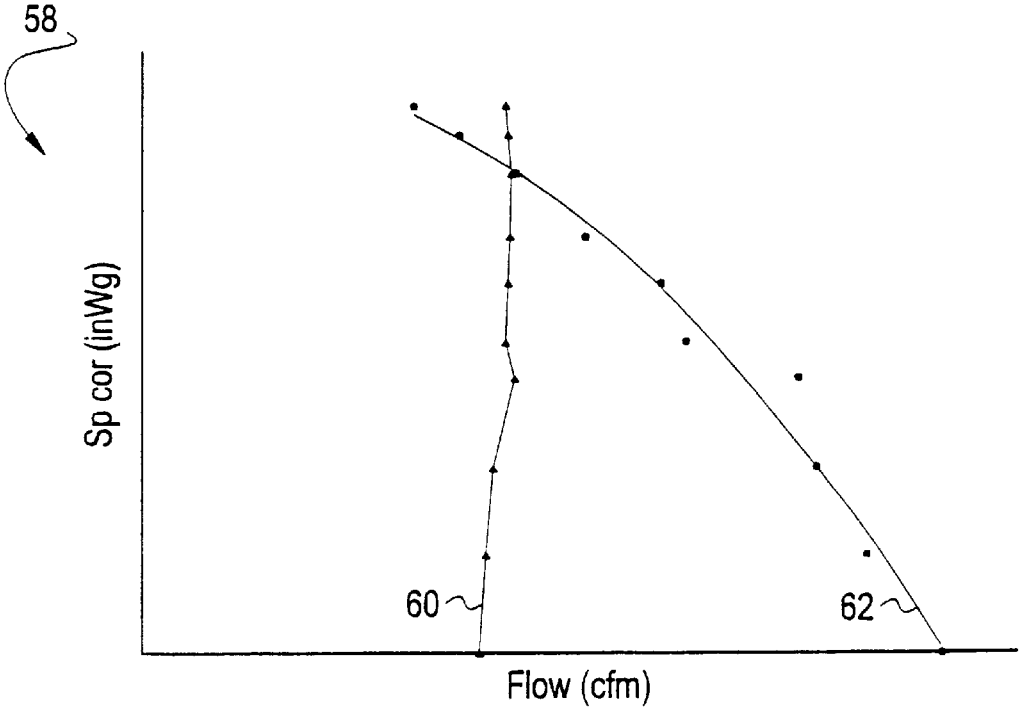
FIG. 4 is a graph illustrating the effect of a restriction in the ductwork of the blower system on airflow to control group components.

Referring to FIG. 4, the dual functionality of the radially and axially placed outlet ducts is shown generally by graph 58. Graph 58 illustrates the flow curve characteristics of static pressure in the ductwork between blower 10 and both the control group components and the AC drive motors. In a plot of corrected static pressure versus volumetric flow rate, a line 60 represents an airflow from a discharge port (not shown) to the control group. A line 62 represents an airflow from a discharge port (not shown) to the AC drive motors. The verticality of line 60 indicates substantially constant airflow at the control group discharge port while the airflow to the AC drive motors is obstructed, as shown by the downward curving of line 62. From graph 58 it can be concluded that neither the amount of backpressure of the air discharged from each outlet duct nor variations in the airflow resistance of the downstream discharge ports connected to each outlet duct will significantly affect the flow of air discharging from the other outlet duct. The pressure and volumetric flow rate of air discharging from one outlet duct is substantially independent of the pressure and volumetric flow rate of air from the other outlet duct. The pressure and volumetric flow rate are instead functions of the fluid backpressure at the discharge port of each outlet duct 34, 36, which are in turn functions of the cross sectional area of each outlet duct 34, 36 and the physical configuration of the ductwork to which it connects.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A blower, comprising: an impeller providing both a radial and an axial airflow said airflows being balanced such that one of said radial and axial airflows is independent of the other of said radial and axial airflows.

2. The blower of claim 1 wherein a restriction in one of said radial and axial airflows does not substantially affect the other of said radial and axial airflows.

3. The blower of claim 2 wherein said radial airflow provides pressurized air for a first apparatus and wherein said axial airflow provides pressurized air for a second apparatus.

4. A multiple outlet centrifugal blower, comprising:

a housing having an inlet port;

an impeller rotatably positioned and supported within said housing;

a first outlet duct configured to receive airflow in a radial direction with respect to a plurality of blades of said impeller; and a second outlet duct configured to receive airflow in an axial direction with respect to said plurality of blades of said impeller.

5. The centrifugal blower of claim 4 further comprising an inlet chamber fixedly connected to said housing.

6. The centrifugal blower of claim 5 wherein said inlet chamber is configured to receive airflow through an opening therein and channel said airflow to said inlet port.

7. The centrifugal blower of claim 6 wherein said first outlet duct is disposed proximate an outer edge of said housing and configured to receive and eject airflow from said first outlet duct in a radial direction with respect to said plurality of blades of said impeller.

8. The centrifugal blower of claim 7 wherein a throat portion of said first outlet duct receives airflow radially from said plurality of blades of said impeller and increases in cross sectional area in the direction of the airflow to lower the volumetric flow rate thereof and channel the airflow away from said centrifugal blower.

9. The centrifugal blower of claim 8 wherein said throat portion includes a tapered surface to define said first outlet duct as being narrower proximate said impeller blade and wider proximate said outer edge of said housing.

10. The centrifugal blower of claim 9 wherein said throat portion is dimensioned to have a width that is substantially equal to the width of said plurality of blades of said impeller.

11. The centrifugal blower of claim 4 wherein said second outlet duct is disposed proximate an outer edge of said housing and is configured to receive airflow axially from said impeller.

12. The centrifugal blower of claim 11 wherein said second outlet duct is configured to extend laterally away from a plane of said impeller and to channel the airflow away from said centrifugal blower.

13. The centrifugal blower of claim 12 wherein said second outlet duct is positioned proximate said outer edge of said housing diametrically opposite said first outlet duct.

* * * * *

UNITED STATES PATENT AND TRADEMARK OFFICE

CERTIFICATE OF CORRECTION

PATENT NO. : 6,382,911 B1
DATED : May 7, 2002
INVENTOR(S) : Mark F. Beltowski

It is certified that error appears in the above-identified patent and that said Letters Patent is hereby corrected as shown below:

Drawings,
Fig. 1, replace “34” for two bearings with the numeral -- 30 --

Column 1,
Line 26, after “of” delete “apparatus” and insert therefor -- apparatuses --

Column 3,
Lines 17 and 19, after “separate” delete “apparatus” and insert therefor -- apparatuses --
Line 21, before “and” delete “apparatus” and insert therefor -- apparatuses --
Line 49, before “in” delete “34” and insert therefor -- 30 --

Signed and Sealed this

Second Day of August, 2005

JON W. DUDAS
*Director of the United States Patent and Trademark Office*